United States Patent [19]

Minkow

[11] Patent Number: 4,635,926

[45] Date of Patent: Jan. 13, 1987

[54] WEIGHT LIFTING TYPE EXERCISING DEVICE

[76] Inventor: Roger E. Minkow, 735 H St., Petaluma, Calif. 94952

[21] Appl. No.: 565,924

[22] Filed: Dec. 27, 1983

[51] Int. Cl.[4] ..... A63B 21/06

[52] U.S. Cl. ..... 272/118; 272/134

[58] Field of Search ..... 272/118, 117, 143, 134, 272/93, 123

[56] References Cited

U.S. PATENT DOCUMENTS

| | | | |
|---|---|---|---|
| 1,052,962 | 2/1913 | Reach | 272/118 |
| 1,546,187 | 7/1925 | Bach | 272/118 |
| 2,648,540 | 8/1953 | Hunter | 272/118 |
| 2,977,120 | 3/1961 | Morris | 272/118 |
| 3,438,627 | 4/1969 | La Lanne | 272/118 |
| 3,708,167 | 1/1973 | Poteieter | 272/134 X |
| 4,286,782 | 9/1981 | Fuhrhop | 272/134 X |
| 4,382,596 | 5/1983 | Silberman | 272/118 |

OTHER PUBLICATIONS

Modular Home Gym—Sears Catalogue-1981.

"Marcy's Gym-King-66"-Marcy Catalogue; 1974; p. 12.

Marcy's 2-Way—Marcy Catalogue; p. 20.

*Primary Examiner*—Richard J. Apley

*Assistant Examiner*—Robert W. Bahr

*Attorney, Agent, or Firm*—George W. Wasson

[57] ABSTRACT

An apparatus for use in exercising human body muscle and elements comprising, a vertical frame member, a horizontal frame member fixed to the bottom of said vertical frame member, and a diagonal frame member extending between said vertical and said horizontal frame members. The combination of vertical, horizontal and diagonal frame members is adapted to permit a human body to recline on said diagonal member while exercising body muscles or elements from a position where there is unlikely to be a strain on back muscles. A set of pulleys and cables operates within the frame members with ends of the cables accessable to both ends of the diagonal frame member. A set of weight elements are attachable to the cables.

13 Claims, 15 Drawing Figures

WEIGHT LIFTING TYPE EXERCISING DEVICE

The present invention relates to a device useful in exercising human body members and in weight training for improving physical condition and muscular strength without excessive strain on body muscles and particularly without strain on the human back. The device has particular usefulness in strengthening those muscles used by gymnasts in performing maneuvers on gymnastic equipment and on floor exercises.

BACKGROUND OF THE INVENTION

Exercising apparatus employing weight displacement means connected to cables are known and apparatus programed to exercise specific muscles are known. Many of such apparatus have been installed in weight training rooms and are available at athletic clubs and facilities. With many of the prior art apparatus the user stands in front of the apparatus and pulls cables connected to the weight displacement means or sits on a bench to engage elaborate programed apparatus to exercise the desired muscles. "Station" weight machines, most of which use cams or levers connected to weights, are not adapted to provide for use by all sizes of users in that the cables connected to the weights are usually at some fixed position and are not adjustable for variations in the height of the user. The same disadvantage applies to the apparatus employing a bench in that the user must fit into the apparatus rather than have the apparatus adjustable to the size of the user.

It is an object of the present invention to provide an exercise apparatus using cables and weights that will be useful to any size of user in that the user is always aligned with the cable pull system regardless of the size of the user.

It is a further object of the present invention to provide an exercise apparatus that will permit exercise of substantially all of the abdomen and upper body muscles without placing strain on the back muscles of the user.

The foregoing and other objects of the present invention will be readily apparent to those skilled in the art from the appended drawings and specification illustrating a preferred embodiment wherein.

FIGS. 9A, 9B, 9C, 9D, 9E, and 9F are representations of various exercises that may be performed with the apparatus of the present invention.

Figure 10:
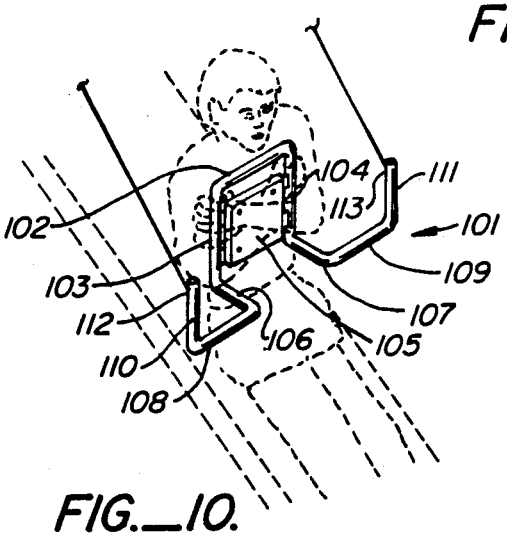

FIG. 10 is a perspective view of an attachment useful with the present invention.

The exercise apparatus 10 of the present invention comprises a frame assembly supporting a set of weights and associated pulley and cable mechanisms for moving the weights within the frame assembly. The frame assembly consists of an upright, rectangular frame portion 12 having a central brace 14 and a pair of guide means 16 and 18, one on each side of the central brace 14. The guide means comprise a pair of parallel rod like members 20 extending from the bottom portion 22 to the top portion 24 of the upright frame portion 12.

Attached to the upright frame portion 12 is a horizontal rectangular portion 26 with a first end fixed to the botton portion 22 of the upright frame portion 12 and a body portion extending generally perpendicular and horizontal from the upright frame portion 12. The horizontal portion 26 has a pair of legs 28 and 30 aligned in symmetry with the central brace 14 of the upright portion 12.

A tilted portion 32 comprises a board-like member 34 fixed at one end to the ends of the legs 28 and 30 of the horizontal portion 26 and at its other end to the central brace 14 of the upright portion 12. The member 34 is further stabilized and strengthened by a brace assembly 36 fixed between the underside of the member 32 and the legs 28 and 30 of the horizontal portion 26.

The assembly of the upright portion 12, the horizontal portion 26 and the tilted portion 32 comprise the frame assembly of the exercise apparatus and produces a stable assembly on which a user may lie and within which a set of weights may be operated. The frame portion 26 of the assembly is preferrably made of hollow members to provide an interior channel for cable passage as will be more fully explained hereinafter.

Figure 1:
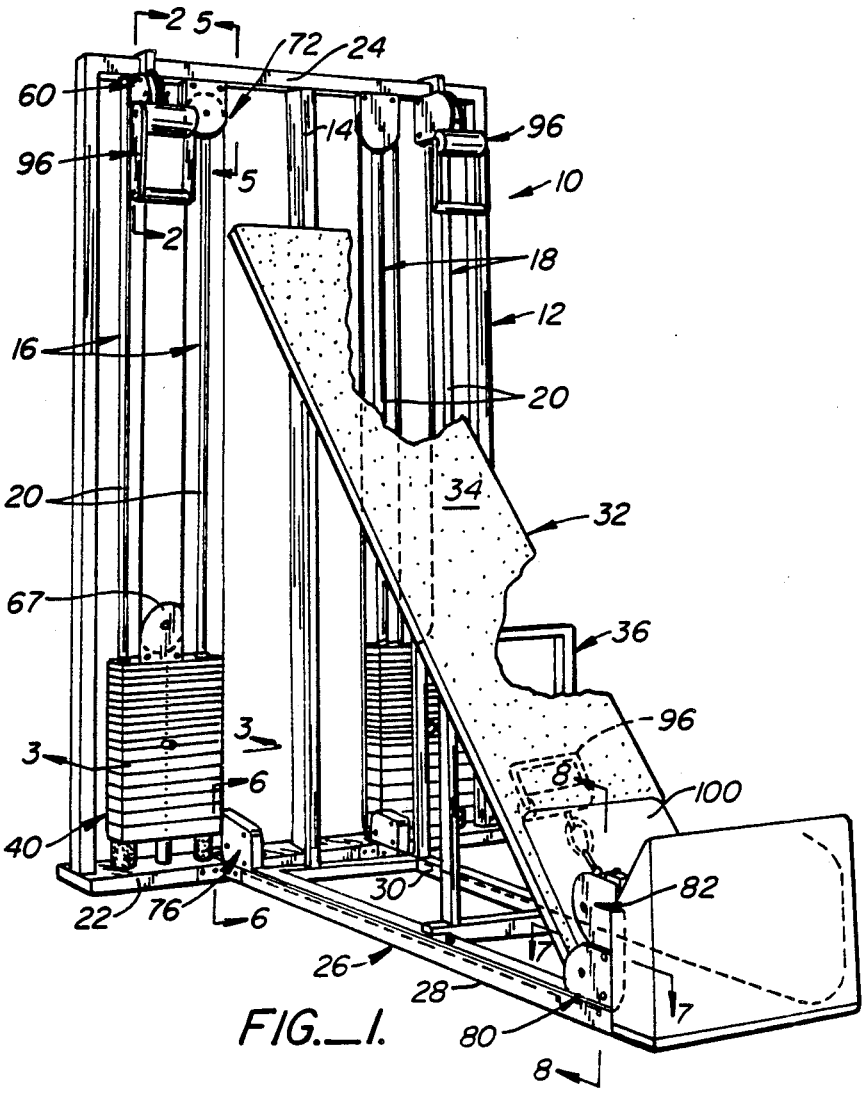
FIG. 1 is a perspective view of the apparatus in its assembled form.
Figure 3:
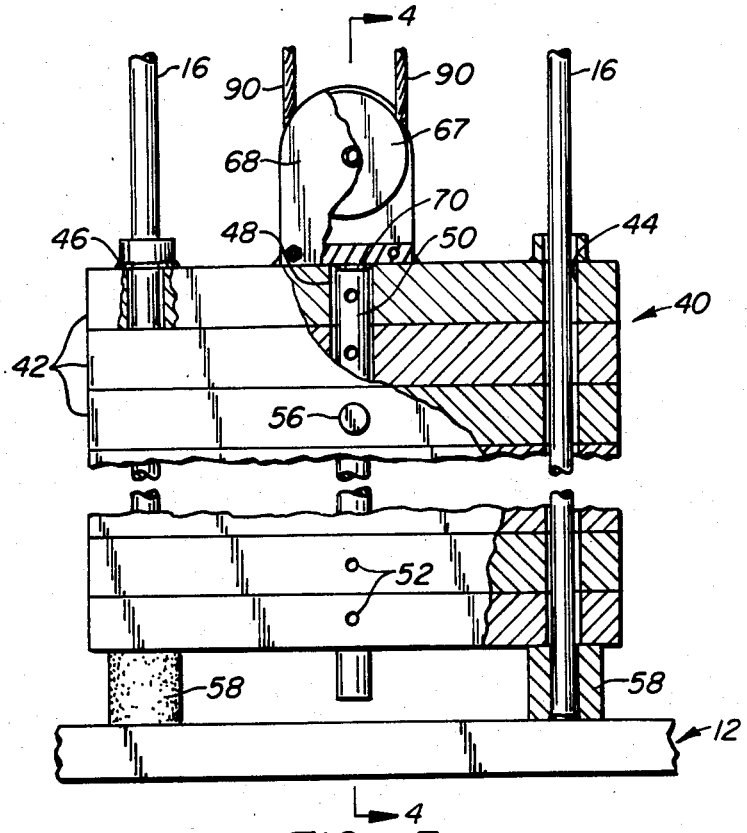
FIG. 3 is a sectional view taken along the lines 3—3 of FIG. 1.
Figure 4:
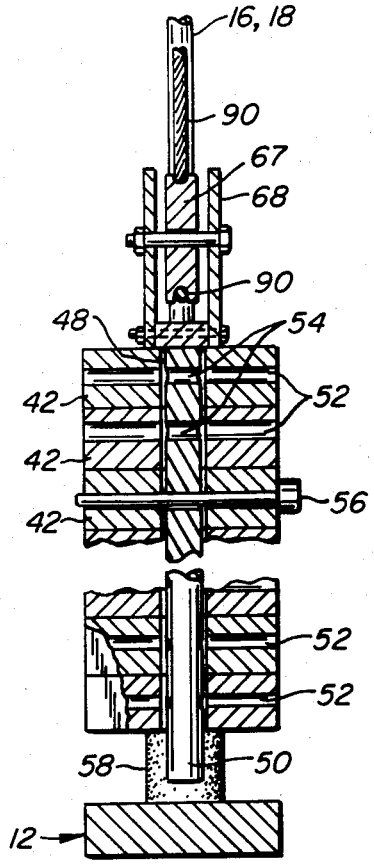
FIG. 4 is a sectional view taken along the lines 4—4 of FIG. 3.

The weight sets 40 of the present invention as shown in FIGS. 1, 3 and 4 comprise a plurality of individual elements 42 all having the same physical dimensions in length and width but varying depths to create different weights. It is of course possible to create the same differences in weight by having the weight elements of different density. The manner of creating the different weight in the elements is not an essential part of this invention. There are two weight sets in the apparatus, one at each side of the inside of the upright frame portion 12 between the central brace 14 and the outside thereof and aligned with the guide means 16 and 18. Each of the elements 42 of the weight sets 40 have three vertical holes extending through it with two of the holes 44 and 46 being near the sides and the third hole 48 being at the center. The guide means 16 and 18 include a pair of rod-like members that are fixed to the inside of the upright portion 12 at its top and bottom with the guide means extending through the holes 44 and 46 and permitting the weights to be moved up and down on the guide means with substantially no frictional resistance. The central hole 48 through the weight elements 42 is adapted to accomodate an extending rod 50 which is attached to a portion on the cable system as will be described hereinafter. The weight elements 42 are further provided with a hole 52 extending horizontally through the elements at about the center of the depth of the elements. The extending rod 50 is also provided with a series of horizontal holes 54 along its length and spaced to be aligned with the holes 52 extending through the weight elements 42. As shown in FIGS. 3 and 4, a pin member 56 is adapted to be inserted into a hole 52 in a weight element 42 and to extend through a hole 54 in the extending rod 50 so as to secure that particular weight element and all weight elements above it to the extending rod. The weight sets rest on the bottom brace of the upright portion 12 on spacers 58 which may hold the guide means in place. The extending rod 50 extends through all of the weight elements 42 of the weight sets 40 but does not touch the bottom brace of the frame.

A pulley and cable mechanism is accomodated within the assembly of the frames and is aligned and adapted to cause up and down movement of the weight sets along the guide means. A particular feature of the pulley and cable mechanism is that it terminates with free ends at the top and at the bottom of the tilted portion 32 of the assembled frame. A separate and independent set of pulley and cable mechanisms is provided for each side of the exercise apparatus; each set being associated with a weight set at the sides of the apparatus.

Figure 2:
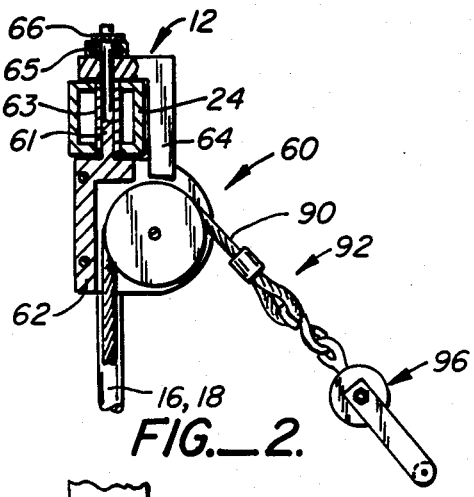
FIG. 2 is a sectional view taken along the lines 2—2 of FIG. 1.

The pulley sets includes a first pulley 60, as shown in FIG. 2, fixed by suitable brackets 62 attached on the underside of the top brace 24 of the upright portion 12. The bracket 62 supporting pulley 60 is supported in the top brace 24 in a manner to permit the bracket 62 to have partial swivel action about an axis extending through the top brace 24. As shown in FIG. 2 the bracket includes as extension 61 formed to extend through a bushing 63 held in the brace 24. At the top of the brace 24 a stop member 64 is fitted over the extension 61 and the entire bracket and stop assembly is supported on a thrust bearing 65 by a suitable keeper 66. With this construction the axis of rotation of the pulley 60 is rotatable about an axis perpendicular to its axis of rotation. Furthermore, with this construction the pulley 60 has its perimeter within the frame assembly generally aligned with the plane of the guide means 16 or 18.

A second pulley 67, as shown in FIGS. 3 and 4, is fixed by suitable brackets 68 to a plate member 70 having the extending rod 50 attached thereto. The pulley 67 has its axis of rotation perpendicular to the plane of the upright portion of the frame and the plane of the pulley is parallel to the plane of the rod-like members of the guide means 16 or 18.

Figure 5:
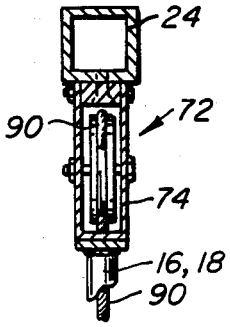
FIG. 5 is a sectional view taken along the lines 5—5 of FIG. 1.

A third pulley 72, as shown in FIG. 5, is fixed by suitable brackets 74 to the underside of the top brace 24 of the upright portion 12. The pulley has its axis of rotation perpendicular to the plane of the upright rectangular portion 12 of the frame, and the plane of the pulley is parallel to the plane of rod-like guide members of the guide means 16 or 18. The inside one of the pair of guide means 16 or 18 is fixed to the under side of the third pulley 72.

As shown in FIG. 1, the perimeter of the pulleys 60, 67 and 72 are aligned so that the cable system connecting the pulleys will extend in parallel paths within the space between the rod-like guide members of the guide means 16 or 18.

Figure 6:
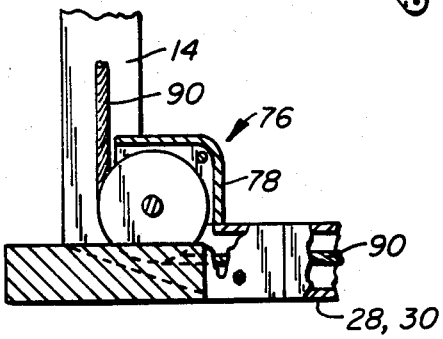
FIG. 6 is a sectional view taken along the lines 6—6 of FIG. 1.

A fourth pulley 76, as shown in FIG. 6, is fixed by suitable brackets 78 to the upper surface of the legs 28 or 30 of the horizontal portion 26 of the frame. Pulley 76 has its axis of rotation parallel to the plane of the upright portion 12 and the perimeter of the pulley is aligned with the corresponding perimeter of pulley 72 so that the cable system connecting the pulleys is parallel to the cables passing through pulleys 60, 67, and 72.

Figure 7:
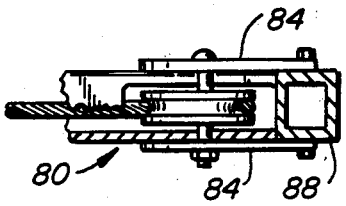
FIG. 7 is a sectional view taken along the lines 7—7 of FIG. 1.
Figure 8:
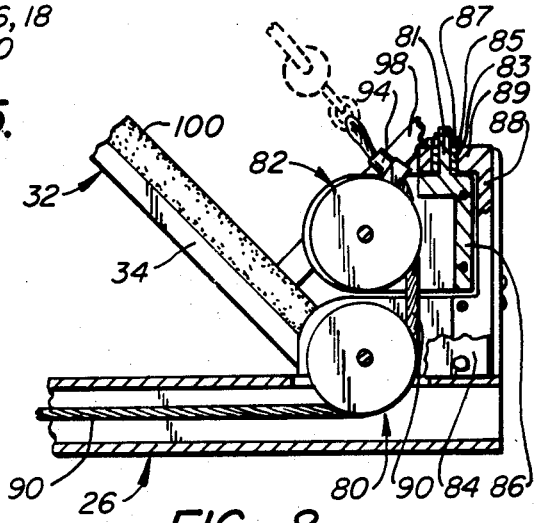
FIG. 8 is a sectional view taken along the lines 8—8 of FIG. 1.

A fifth pulley 80 and a sixth pulley 82, as shown in FIGS. 7 and 8, are attached by suitable brackets 84 and 86, respectively, to an upright member 88 attached to the ends of legs 28 and 30 away from the upright porton 12. The axis of rotation of the pulley 80 is parallel to the plane of the upright portion 12. The perimeter of pulley 80 is aligned with the corresponding perimeter of pulley 76 and the aligned perimeters of the pulleys are positioned within cutout portions of the legs 28 or 30 so that the cable system connecting these two pulleys is within the hollow interior portion of the legs.

The bracket 86 supporting pulley 82 is supported in an extension 89 of upright member 88 in a manner to permit the bracket to have partial swivel action about an axis extending through the extension 89. As shown in FIG. 8 the bracket includes an extension 81 formed to extend through a bushing 83 held in the extension 89 of member 88. The entire assembly is held against the extension 89 at a thrust bearing 85 by a keeper 87. With this construction the axis of rotation of pulley 82 is rotatable about an axis perpendicular to the axis of rotation. The pulleys 80 and 82 are aligned with each other and the board-like member 34 so that the pulleys are at the edge of the board and pulley 82 is slightly above the board.

The pulleys just described are duplicated at each side of the apparatus, one for each weight set.

A flexible means 90, previously referred to as a cable, extends through the entire pulley system passing over the perimeters of the pulleys in order and is adapted at each end thereof at pulleys 60 and 82 with enlarged stop means 92 and 94, respectively, that will not pass through the pulleys and their brackets. At the first pulley 60 the stop means 92 engages the stop 64 and at the sixth pulley 82 the stop 94 engages the extension 89. The stop means keep the cable secure against each of the pulleys and within the frame of the apparatus. The cable is flexible so as to pass easily over each of the pulleys but is substantially not elongatable so that it does not stretch wtihin the system of pulleys. The flexible means 90 with the stop means 92 and 94 and the attachment arrangement of the extending rod 50 to the weight assembly 40 permit the weights to be lifted within the frame assembly by pulling on either end of the flexible means at at pulleys 60 or 82. To assist in pulling of the cable or flexible means and attached weights, a handle assembly 96 is attachable to the stop means 92 or 94.

The swivel action of the first pulley 60 and sixth pulley 82 permit the cables 90 to be pulled at a variety of angles away from the face of the upright frame portion 12 or away from the base of the tilted portion 32 without friction against the edges of the pulley wheels. As will be more fully understood in the discussion of the use of the exercise apparatus, this swivel action makes the apparatus more useful in some muscle exercises.

The exercise apparatus is completed for use by providing a foot board 98 at the end of the tilted member near the attachment between the horizontal portion 26 and the tilted portion 32 as best shown in FIG. 8. The board-like member may be covered with a padding, as at 100 in FIGS. 1 and 8, for the comfort of the user and the entire board-like member may be covered to make its use more pleasant.

FIGS. 9A through 9F illustrate several of the useful exercises that may be performed with the apparatus of the present invention. As previously stated, the apparatus is particularly useful in exercising, training and strengthening those muscles used by gymnasts in floor and apparatus events.

Figure 9A:
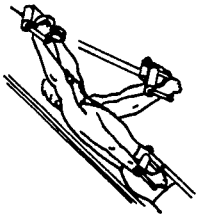

FIG. 9A illustrates a front lever exercise for pectoralis, tricepts, and upper back muscle development simulating the front lever seen on the rings in gymnastics. In this exercise the handles 96 are attached to the cable system 90 at pulley 60 and the user pulls the cables downward wtih straight arms while lying on the board 34.

Figure 9B:
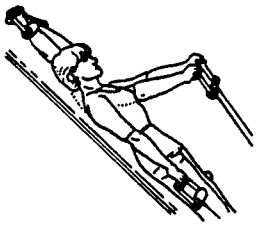

FIG. 9B illustrates a front raise for developing the anterior (front) aspect of the deltoid muscle. This exercise is performed with the handles 96 attached to the cable system at pulley 82 and the user pulls upward with straight arms while lying on the board 34.

Figure 9C:
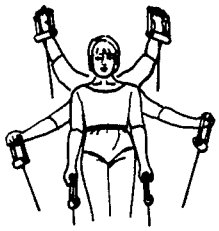

FIG. 9C illustrates a lateral raise exercise for developing lateral (side) aspects of the deltiod muscle. In this exercise the user and apparatus are in the same position as in FIG. 9B and the user pulls upward and to the side with arms straight. The swivel action of the sixth pulley 82 permits the user to pull to the side without increased resistance from the pulley wheel.

Figure 9D:
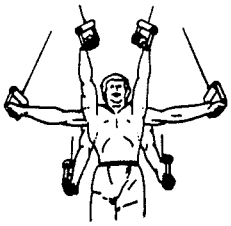

FIG. 9D illustrates a butterfly exercise useful in preparing a gymnast for performing the exercise that is known as the Iron Cross. This exercise develops the bicepts, tricepts, pectoralis and lat muscles. The apparatus is arranged with the handles 96 at pulley 60 and the user lying on the board 34. The handles are pulled downward, outward and parallel to the body with the arm straight. The swivel action of the first pulley 60 permits the user to pull outward and parallel to the body without increased resistance from the pulley wheel.

Figure 9E:
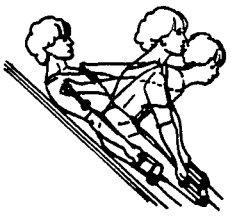

FIG. 9E illustrates back raises and back pull exercise. The back pull is performed by lying on the board the bending at the waist to grasp the handles 96 in the users hands and sitting up and lowering down to the rest position on the bench. This exercise is repeated with the arms along side or ahead of the body and is used to develop the low back muscles without the strain usually associated with other back exercises. The back raise is performed with the handles in the hands while sitting on the board 34, then the arms are moved backward and along the board. This exercise develops posterior (back) aspects of deltoid muscles. In both of the exercises the handles 96 are attached at the pulley 82.

Figure 9F:
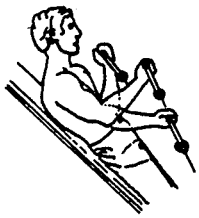

FIG. 9F illustrates arm curl exercises for developing bicep muscles and forearm flexors. The apparatus is arranged with the handles attached at the pulley 82 and the user lying on the board 34.

FIG. 10 illustrates an attachment that may be used with the present exercise apparatus and illustrates, in phantom, the use of the apparatus in as exercise.

As illustrated, the attachment 101 comprises a member formed to establish a central u-shaped portion 102 having legs 103 and 104. A plate like element 105 fixed by suitable means to the legs 103 and 104 to be within the u-shaped portion 102. Legs 103 and 104 have an outward extension 106 and 107 at right angles to the plane of the plate 105 and each extension has a further folded portion 108 and 109 extending parallel to the plane of the plate 105. The folded portions 108 and 109 are further formed with an extension 110 and 111. The extensions 110 and 111 are adapetd with a means, such as a hole at 112 and 113, to permit the cables to be connected to the attachment.

As illustrated in phantom in FIG. 10, the attachment is used in an exercise by folding the users arms around the u-shaped portion 112 holding the plate portion 105 against the chest of the user. The outward extensions 106 and 107 accomodate the folded arms of the user and the folded portions 108 and 109 place the extensions 110 and 111 in the proper position for connection to the cables 90. This construction permits the connection to cables 90 to be aligned with the third or sixth pulley depending on which end of the cable is to be engaged.

This attachment permits the user to perform weighted sit-ups and insures that the abdomen muscles will be used in the exercise rather than upper body or arm muscles.

It should be understood that many variations of the above exercises and others may be performed with the apparatus of the present invention. Some variations are merely changing the hand position on the handles to exercise different muscles, and other exercises may be performed by lying face down on the board 34. Because of the position of the pulleys in relation to the board member and the design of the exercises less strain is placed on the lower back muscles. The particular advantage of the apparatus of the present invention and its use is that the user may exercise specific muscles without putting pressure on the intervertebral discs. The apparatus permits the user to bend at the knees, and to tilt the pelvis forward, taking the strain off the lower back. Furthermore, the apparatus may be used to perform an entire range of leg exercises by attaching an ankle strap to either the upper or lower pulleys at the stops 92 or 94.

The apparatus of the present invention is useable by users of any size in that the handles and cables are aligned with the body of the user. The board on which the user lies is in line with both ends of the cable system placing the user in alignment with the handles regardless of the users size. Further, because the weight system provides for a broad range of adjustment, the user may have a wide variation of strength while still obtaining the benefits of the apparatus and the exercises that may be performed on the apparatus.

While a certain preferred embodiment of the invention has been specifically disclosed, it should be understood that the invention is not limited thereto as many variations will be readily apparent to those skilled in the art and the invention is to be given its broadest possible interpertation within the terms of the following claims.

What is claimed is:

1. A device for weight training or assisting in exercising body members comprising:

(a) a frame assembly including, an upright rectangular portion having a top end and a bottom end with a central brace and a pair of guide means, one of said pair of guide means being on each side of said central brace, a horizontal rectangular portion having a remote end and a fixed end, said fixed end being fixed to said upright rectangular portion at said bottom end of said upright rectangular portion and having outside edges aligned in symmetry with said central brace and said guide means, a tilted portion having one end fixed to said remote end of said horizontal rectangular portion and the other end fixed to said upright rectangular portion at said central brace at a position between said top end and said bottom end of said upright rectangular portion, (b) a plurality of separate weight elements slideably positioned on said pair of guide means, said plurality including weight elements of different weight with weight elements of the same weight being positioned on each guide means in the same order, said weight elements having a central guide hole therethrough establishing a vertically aligned set of holes having an axis parallel to said guide means, each of said weight elements also having a horizontal hole therethrough aligned with said central guide holes, and means engageable with said weight elements at said horizontal holes, (c) two sets of pulley means and flexible means cooperation with said pulleys, each set of pulley means comprising a plurality of separate but cooperating pulleys, one each of said pulley sets being associated with said guide means and said weight elements at each side of said central brace and at each side of said tilted portion of said frame, said set of flexible means comprising separate flexible means associated with each set of pulley means, (d) each of said sets of pulleys including, a first pulley attached to the top end of said upright rectangular portion and on the inside thereof, said first pulley of each set being positioned with respect to said guide means at each side of said central brace, a second pulley attached to said means engageable with said weight elements at said guide means, said second pulley being in alignment with said first pulley, a third pulley attached to the top end of said upright rectangular portion and on the inside thereof, said third pulley being positioned with respect to said guide means adjacent to said central brace and at each side thereof, said third pulley being spaced from said first pulley by the diameter of said second pulley, a fourth pulley attached to the bottom end of said upright rectangular portion of said frame, said fourth pulley being attached on the inside of said upright rectangular portion and positioned with respect to said guide means on said upright rectangular portion, said fourth pulley being aligned with the side of said third pulley closest to said central brace, said fourth pulley being further aligned with respect to an outside edge of said fixed end of said horizontal rectangular portion of said frame, a fifth pulley attached to said horizontal rectangular portion at said remote end and aligned with respect to an outside edge of said horizontal rectangular portion, said fifth pulley being further attached to said horizontal rectangular portion at the location of attachment between said remote end of said horizontal rectangular portion and said one end of said tilted portion of said frame, a sixth pulley attached to said frame with respect to said horizontal rectangular portion above said fifth pulley and in alignment with said tilted portion, (e) said flexible means extending from said first pulley to said sixth pulley and passing through each pulley in order, said flexible means being flexible in lateral movement but not elongatable, (f) and a pair of stop means associated with each pulley set, one of said stop means being fixed to said flexible means at said first pulley and the other of said stop means being fixed to said flexible means at said sixth pulley, said stop means cooperation with said first and sixth pulley means and said flexible means so as to permit said stop means to be pulled away from said pulleys but not to be pulled through said pulleys, said device permitting a user to recline on said tilted portion and to grasp either or both of said stop means and to lift said weight elements in adjustable combinations with pulling forces applied to said stop means and transmitted through said flexible means and said pulley means from either the top or the bottom of said frame assembly at said tilted portion.

2. The apparatus of claim 1 wherein said means engagable with said weight elements at said second pulley includes a rod-like portion extending downwardly therefrom, said rod-like portion cooperating with said guide holes in said weight elements, said rod-like portion having a series of horizontal holes therethrough spaced in accordance with the horizontal holes through said weight elements, and a fastening means cooperating with said horizontal holes through said weight elements and said rod-like member to engage said weight elements to said rod-like member and said second pulley.

3. The apparatus of claim 1 wherein said first pulley is attached to the upright rectangular portion with a swivel means permitting the axis of rotation of said pulley to be rotatable about as axis perpendicular to said axis of rotation.

4. The apparatus of claim 1 wherein the axis of rotation of said second pulley is perpendicular to the plane of said upright rectangular portion of said frame.

5. The apparatus of claim 1 wherein the axis of rotation of said third pulley is perpendicular to the plane of said upright rectangular portion of said frame.

6. The apparatus of claim 1 wherein the axis of rotation of said fourth pulley is parallel to the plane of said upright rectangular portion of said frame.

7. The apparatus of claim 1 wherein the axis of rotation of said fifth pulley is parallel to the upright rectangular portion of said frame.

8. The apparatus of claim 1 wherein said sixth pulley is attached with respect to said horizontal rectangular portion with a swivel means permitting the axis of rotation of said pulley to be rotatable about as axis perpendicular to said axis of rotation.

9. The apparatus of claim 1 wherein the fourth and fifth pulleys are positioned so as to align said flexible means within an element of said horizontal rectangular portion.

10. The apparatus of claim 1 with the addition of a brace member attached to said tilted portion of said frame assembly adjacent to said one end of said tilted portion fixed to said remote end of said horizontal rectangular portion.

11. The apparatus of claim 1 with the addition of releasable handle members connectable to said stop means at either said first or said sixth pulley.

12. The apparatus of claim 1 with the addition of means attachable to said flexible means at an end thereof, said means including a u-shaped portion with a plate-like member attached to the legs of said u-shape, said legs having extending portions permitting attachment of said attachable means to said flexible means away from and adjacent to said plate-like member.

13. The apparatus of claim 12 wherein said extending portions from said legs include an outward extension, a folded portion and an extension from said folded portion whereby said attachment of said means to said flexible means is in alignment with said third or sixth pulley.

* * * * *